US007520507B2

(12) United States Patent
Gak

(10) Patent No.: US 7,520,507 B2
(45) Date of Patent: Apr. 21, 2009

(54) METHOD OF A PAYOUT DICE GAME

(76) Inventor: Alexander Gak, 253 Warren Ave., For Lee, NJ (US) 07024

( * ) Notice: Subject to any disclaimer, the term of this patent is extended or adjusted under 35 U.S.C. 154(b) by 439 days.

(21) Appl. No.: 11/243,870

(22) Filed: Oct. 5, 2005

(65) Prior Publication Data

US 2007/0075489 A1 Apr. 5, 2007

(51) Int. Cl.
*A63F 9/04* (2006.01)
*A63F 1/00* (2006.01)
*A63F 3/08* (2006.01)

(52) U.S. Cl. ..... 273/146; 273/191; 273/274; 273/292

(58) Field of Classification Search ..... 273/146, 273/274

See application file for complete search history.

(56) References Cited

U.S. PATENT DOCUMENTS

| | | | | |
|---|---|---|---|---|
| 1,668,818 | A | 5/1928 | Neale, Jr. et al. | |
| 3,810,627 | A | 5/1974 | Levy | |
| 4,431,194 | A | 2/1984 | Lapadura | |
| 4,688,803 | A | 8/1987 | Ollington | |
| 5,031,914 | A | 7/1991 | Rosenthal | |
| 5,133,559 | A | 7/1992 | Page | |
| 5,176,381 | A | 1/1993 | Winters | |
| 5,513,850 | A | 5/1996 | Vancura | |
| 5,513,851 | A | 5/1996 | Harris | |
| 5,649,704 | A | 7/1997 | Dobbin | |
| 5,660,393 | A * | 8/1997 | Dreger | 273/292 |
| 6,173,955 | B1 | 1/2001 | Perrie et al. | |
| 6,213,876 | B1 | 4/2001 | Moore, Jr. | |
| 6,273,423 | B1 | 8/2001 | Promutico | |
| 6,508,469 | B2 | 1/2003 | Promutico | |
| 6,708,974 | B1 | 3/2004 | Brown, III | |
| 6,776,413 | B2 | 8/2004 | Brown, III | |
| 6,893,019 | B2 | 5/2005 | Gaygen | |
| 6,896,264 | B1 | 5/2005 | Haber | |
| 2003/0168806 | A1 | 9/2003 | Nigale | |
| 2005/0001379 | A1 * | 1/2005 | Moore, Jr. | 273/292 |
| 2005/0077675 | A1 | 4/2005 | Gaylor | |
| 2005/0121851 | A1 * | 6/2005 | Cacas | 273/146 |

* cited by examiner

*Primary Examiner*—Gene Kim
*Assistant Examiner*—Michael D Dennis
(74) *Attorney, Agent, or Firm*—Howard & Howard Attorneys PLLC

(57) ABSTRACT

A method of playing a dice game that uses a pair of identical die. The dice have a plurality of possible outcomes and the game establishes a payout multiplier for each possible outcome of the dice. A wager is established by a player on one of the outcomes. The player wager includes a wager amount and a selected wager outcome. The dice are rolled to establish a rolled outcome of the dice. The rolled outcome is compared to the selected wager outcome to identify matches of wagers to the rolled outcome. If a player has match, a payout is determined by a function of the product of the wager amount and the fractional payout multiplier associated with the rolled outcome of the dice.

6 Claims, 6 Drawing Sheets

METHOD OF A PAYOUT DICE GAME

BACKGROUND OF THE INVENTION

1. Field of the Invention

The present invention relates to a method of playing a dice wagering game and a method for determining a payout.

2. Background of the Invention

Various dice games already exist in a gaming arena. For example, U.S. Pat. No. 6,896,264 offers a dice game that uses two six-sided dice and with a payout for either a single roll or a wager where a winner is determined two consecutive rolls. U.S. Pat. No. 6,893,019 offers a dice game that uses three six-side dice to determine a winning wagers. The game offers various payout odds for each wager and a winning wager is determined by the sum of the single die, a pair of dice, or all three dice, on a single roll of all three dice.

However, few of the prior art games ever are successful because they often have complex wagering schemes or are too simple to captivate a player.

The present invention is aimed at one or more of the problems as set forth above.

SUMMARY OF THE INVENTION

In one aspect of the present invention, a method of playing a dice game is provided. The method includes the step of using a pair of identical die. The dice have a plurality of possible outcomes and the game establishes a payout multiplier for each possible outcome of the dice. A wager is established by a player on one of the outcomes. The player wager includes a wager amount and a selected wager outcome. The dice are rolled to establish a rolled outcome of the dice. The rolled outcome is compared to the selected wager outcome to identify matches of wagers to the rolled outcome. If a player has match, a payout is determined by a function of the product of the wager amount and the fractional payout multiplier associated with the rolled outcome of the dice.

In a second aspect of the present invention, a method of playing a dice game having a pair of die is provided. Each die has an equal number of faces. Each die has a plurality of an equal number of positive values and negative values. Each face has an associated one of the positive and negative values. An outcome of the two dice is equal to the sum of the associated values of a top face for each die. The method includes the steps of establishing a payout multiplier for each possible outcome of the dice and establishing a wager by a player on one of the outcomes. The player wager has a wager amount and a selected wager outcome. The selected wager outcome is one of a positive dice outcome or a negative dice outcome. The method also includes the steps of rolling the two dice to establish a rolled outcome of the dice, comparing the rolled outcome to the wager outcome and paying to the player a payout as a function of a product of the wager amount and the payout multiplier if the rolled outcome matches the wager outcome.

In a third aspect of the present invention, a method of playing a dice game having a pair of dice each having six faces presenting the following numbers ½, ¼, ⅛, −½ −¼, and −⅛ is provided. The method includes the steps of establishing a first wager area for each player presenting a first wager indicator to indicate a first group of numbers: 1, ¾, ⅝, ½, ⅜, ¼, and ⅛ and a second wager indicator to indicate a second group of numbers: −1, −¾, −⅝, −½, −⅜, −¼ and −⅛; establishing a second wager area for each player presenting a third wager indicator to indicate the first group of numbers and a fourth wager indicator to indicate the second group of numbers; and establishing a third wager area for each player presenting a first wager indicator to indicate each of first group of numbers, the second group of numbers and zero. The method also includes the steps of establishing player wagers on one of the wager indicators in at least one of said wager areas for each player to define a wager outcome for each player, rolling the two dice to rolled faces presenting rolled numbers, algebraically summing said rolled numbers to produce a rolled outcome, and comparing the rolled outcome to the wager outcome to identify winning matches of wager outcome to the rolled outcome. The method further includes the steps of paying each player having a winning match in the second wager area and the third wager area, leaving as a push a player wager in the first wager area when the rolled outcome equals zero, paying each player having a winning match in the first wager area a payout equal to the player wager plus the player wager multiplied by the rolled outcome to increase the player wager by the fractional value of the rolled sum regardless of the rolled outcome being positive or negative, and paying each player having a player wager in the third wager area on a wager outcome different than the rolled outcome an amount equal to the player wager minus the player wager multiplied by the rolled outcome to decrease the player wager by the fractional value of the rolled outcome regardless of the rolled sum being positive or negative.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

With reference to the drawings, wherein like numerals indicate corresponding parts throughout the several views, and in operation, the present invention provides a device and method for the play of a dice game. The device may take the form of a mat, table cloth, cover, place mat or the like, and can be implemented as software for play on a computer, a video game, and as a stand alone or for play over a computer network or the internet.

Figure 1:
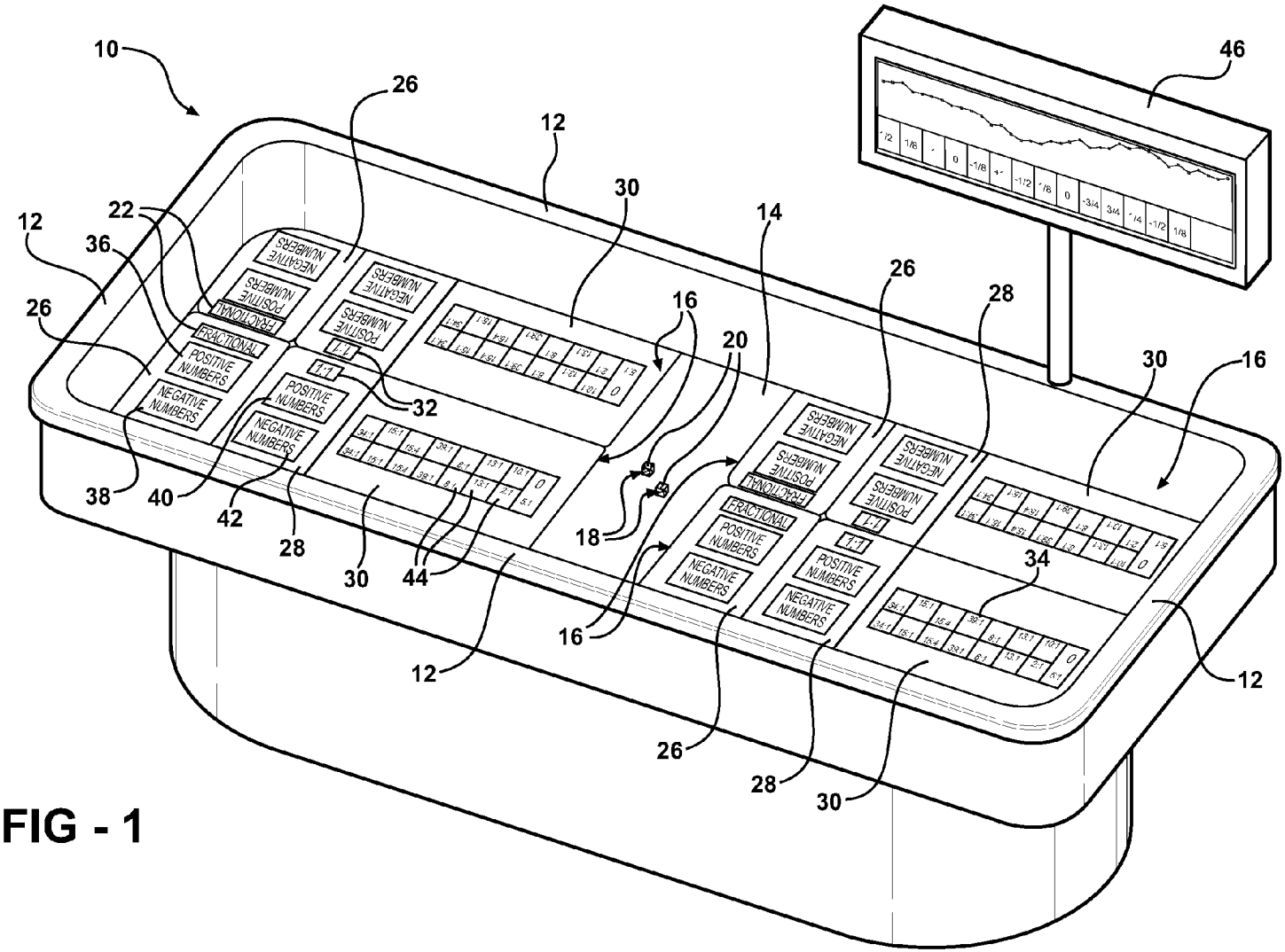
FIG. 1 is a perspective view of a table game.

As shown in FIG. 1, an embodiment of the device and method as played on a table 10. The table 10 is similar to those used for the play of craps, including a rail 12 surrounding a playing surface 14. The rail 12 extends up from the playing surface 14 for keeping the dice within the playing surface 14. The playing surface 14 further defines a wagering area 16. The game involves a player predicting the random outcomes of a pair of die 18. Each die 18 has a plurality of faces 20, e.g., six. The dice 18 have a plurality of rolled outcomes that comprises of the combination of one the faces 20, or associated values, from each of the die 18. In one embodiment, the outcome of the dice 18 corresponds to a fractional payout multiplier 22 that is less than or equal to one. The fractional payout multiplier 22 determines a payout for each outcome of the dice 18.

The dice 18 are identical having an equal number of sides, and faces. In one embodiment, each face 20 of the die 18 presents either a positive or negative value. In addition, each die 18 has the same indicators, with one face 20 indicating a positive value and another face 20 presents an opposite negative value. For example, if the die 18 had a face 20 presenting a four another face 20 on the same die would present a negative four. The numerical markings on the dice could indicate the positive and negative values utilizing various indications such as a sign before the value, coloring, i.e., red for negative and green for positive, or any additional marking known in the art. The rolled outcome of the dice 18 is equal to the sum of the associated values of a top face 20 for each of the rolled die 18. In one embodiment, the dice 18 indicate a positive or negative value as discussed above, for this embodiment the rolled outcome of the dice 18 could be a positive value, a negative value or a zero. For example, the dice 18 are rolled and the rolled outcome is determined by combining or algebraically summing the top face 20 presented on each of the die 18, as shown in the following table:

| Die 1 (top face) | Die 2 (top face) | Rolled Outcome (for the pair of dice) |
|---|---|---|
| ¼ | −⅛ | ⅛ |
| −½ | −½ | −1 |
| ½ | −⅛ | ⅜ |

Figure 2:
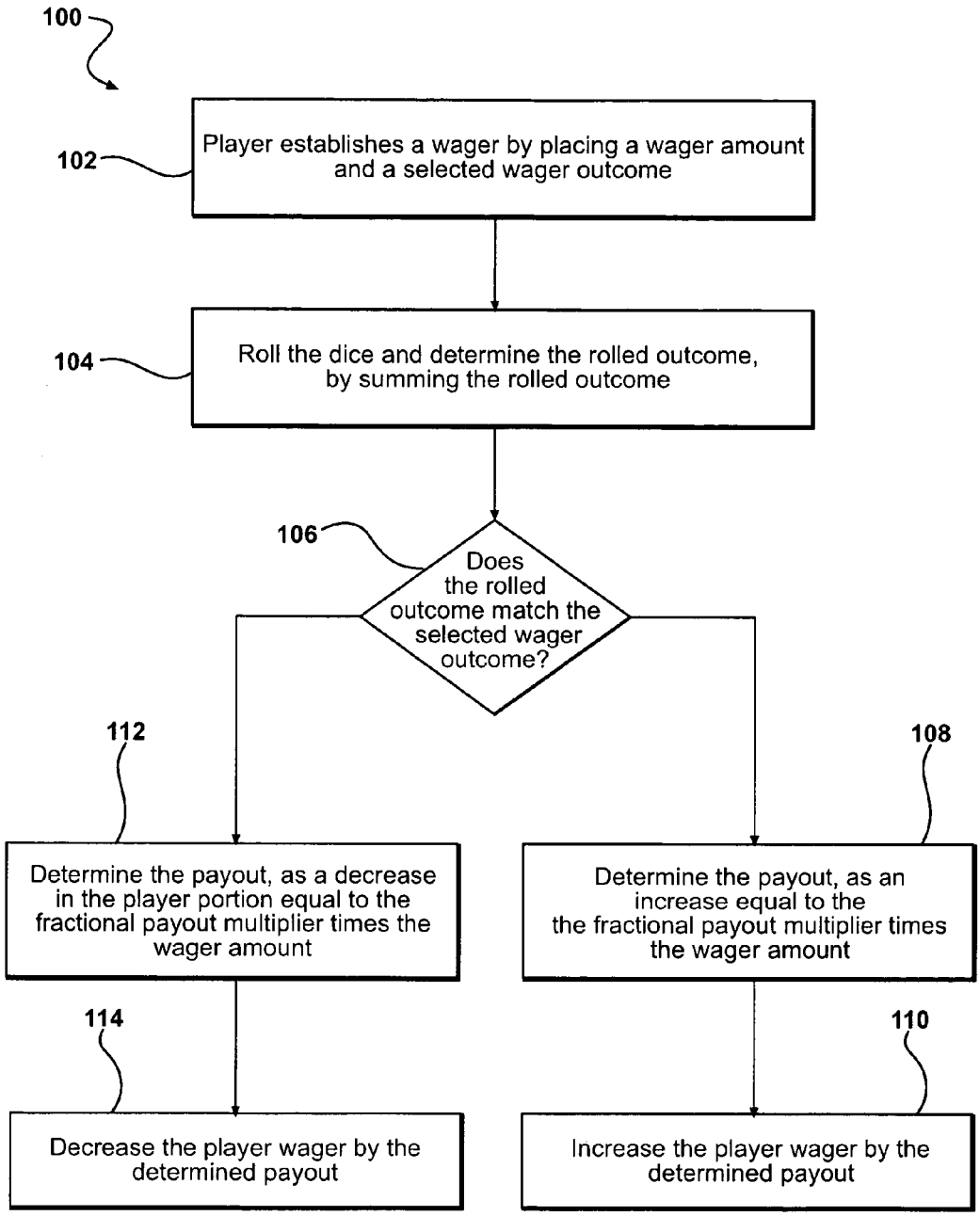
FIG. 2 is a block diagram illustrating a fractional payout.

As illustrated in FIG. 2, a method 100 that includes a first step 102, to begin the game, a player places a wager on one of the rolled outcomes to indicate a selected wager outcome. Each wager consists of a wager amount and the selected wager outcome, corresponding to the player's prediction of a next rolled outcome of the dice 18. In a second step 104, the dice 18 are rolled to establish a rolled outcome of the dice 18 based on the sum of the values or indicators on the top faces 20 of the rolled dice 18. As known in the art, the dice could be rolled by a player, a machine, randomly generated by a computer program, or a croupier. In a third step 106, the rolled outcome of the dice 18 is compared to the selected wager outcome. In a fourth step 108, a payout is calculated for a match between the selected wager outcome and the rolled outcome. The payout is a portion of the wager amount calculated by a function of the product of the wager amount and the fractional multiplier, i.e., the wager amount times the fractional multiplier. In a fifth step 110, the payout is paid increasing the wager amount. Alternatively, in a fourth step 112, if the rolled outcome does not match the selected wager outcome, the payout is a portion of the wager amount calculated by the function of the product of the wager amount and the fractional multiplier. Finally, in an alternative fifth step 114, the wager amount is decreased by the payout.

The payout is determined as a function of a product of the wager amount and the fractional payout multiplier. For example, if a given outcome (combination of the end result for each die) has an established fractional multiplier of ¼, or 0.25, if a player establishing a wager on this selected wager outcome and the rolled outcome matches, are paid the wager amount plus the payout, calculated by a function equal to the product of the wager amount times the fractional payout, or ¼, to increase the player wager by ¼. However, if the selected wager outcome does not match the rolled outcome, the payout is subtracted from the wager amount to partially reduce or decrease of the wager amount. However, it is to be understood that each possible rolled outcome of the dice has an established fractional multiplier, that is a fractional value less than or equal to one.

One embodiment of the dice game includes the use of a pair of six sided die. The dice each have six faces and each face presents one of the following fractional numbers ½, ¼, ⅛, −½, −¼ and −⅛. Therefore the possible rolled outcomes are 1, ¾, ⅝, ½, ⅜, ¼, ⅛, −1, −¾, −⅝, −½, −⅜, −¼ and −⅛, and a zero. The established fractional multiplier for each rolled outcome is equal to the absolute value of the rolled outcome. For example, the player places a wager that includes a wager amount of $100 on a selected wager outcome of ½ as the player's prediction of the next rolled outcome. The dice are then rolled and the top face 20 of each die 18 is combined, by summing the indicated value, to determine the rolled outcome. If the rolled outcome of ½ matches the selected rolled outcome of the wager, the fractional payout multiplier, the absolute value of rolled outcome, or ½ in the given example, the payout is a function of the product of the fractional payout multiplier times the wager amount of $100 to equal a payout of $50. Since the rolled outcome and the selected wager outcome match the payout is added to the wager amount of 100 for a total of $150. However, if the player placed the wager amount on the selected wager outcome of ¼ and the rolled outcome was ½, the payout is the same as calculated above and equal to $50, but for a selected wager outcome not matching the rolled outcome, the payout of $50 is subtracted from the wager amount of $100 therefore decreasing the player wager to $50.

As shown in FIG. 1, another embodiment of the table 10 or a device establishes the game with a wager area 16 divided into several wager areas, a first wager area 26, a second wager area 28 and a third wager area 30. Each of the wager areas 26, 28, 30 provides different payouts and increased wagering options and further adds the possibility for larger payouts.

The first wager area 26 incorporates the fractional payout multiplier 22 to determine a payout as already discussed above and establishes the fractional payout multiplier 22 for each rolled outcome. The payout, as discussed above, is added to the wager amount if there is a match between the rolled outcome and the selected wager outcome. However, the payout is subtracted from the wager amount if the selected wager outcome does not match the rolled outcome. This embodiment includes the second wager area 28 for a player to establish a second wager. The payout of the second wager area 28 is determined by a second payout multiplier 32 that is established for all wagers in the second wager area. The third wager area 30 allows for a player to establish a third wager on each of the possible rolled outcomes, and a third payout multiplier 34 established for each of the possible rolled outcomes. The third multiplier 34 can vary, as known in the art, according to the odds of the rolled outcome which allow for payouts that are increase based on the odds of each of the rolled outcomes.

The first wager area, in this embodiment, as shown in FIG. 1, includes a first wager indicator 36 and second wager indicator 38. The first wager indicator 36 is for a player to place a wager indicating a first group of rolled outcomes as the selected wager outcome, which in this embodiment, are the rolled outcomes that are positive numbers. The second wager indicator 38 is for a player to place a wager indicating a second group of rolled outcomes as the selected wager outcome, which in this embodiment, are the rolled outcomes that are negative numbers. However, it is understood that the first and second group can include any combination of possible rolled outcome.

A player establishes a wager by placing a first wager amount on the first wager indicator 36 or the second wager indicator 38, selecting the selected wager outcome to indicate the player's prediction on the next rolled outcome. A payout is determined by comparing the rolled outcome to the selected wager outcome as discussed above and utilizing the fractional payout multiplier 22 to determine the payout. A rolled outcome of zero results in a push, leaving the player wagers in the first wager area 26. It is understood that any rolled outcome could further indicate a push, the described embodiment utilizes zero since the dice contain both positive and negative values or numbers.

The second wager area 28 is established by presenting a third wager indicator 40 to indicate the first group of rolled outcomes as the selected wager outcome and a fourth wager indicator 42 to indicate the second group of rolled outcomes as the selected wager outcome. The second payout multiplier 32 is established for the third wager indicator 40, and the fourth wager indicator 42. A player establishing a second wager places a second wager amount on the third or fourth indicator 40, 42 to indicate the selected wager outcome. The rolled outcome is compared to the selected wager outcomes of the second wager area 28, and a second payout is disbursed if the rolled outcome matches the selected wager outcomes. The second payout is equal to an amount as a function of a product of the wager amount of the second wager and the second payout multiplier 32. For example, of the second payout multiplier 32 could be set as one for the third and fourth wager indicator 40, 42, meaning that the payout is equal to the wager amount. Therefore, a match between the rolled outcome and the selected wager outcome would double the wager amount. However, if the selected wager does not match the rolled outcome the house collects the wager amount. It should be understood that the second payout multiplier 32 could be of any multiplier to establish variations of payouts for the third and fourth wager indicators 40, 42.

The third wager area 30 is established and presents a wager indicator 44 for each possible rolled outcome of the dice. A third payout multiplier 34 is established for each possible rolled outcome. A third wager is established by a player placing a wager amount on a selected wager indicator 44 in the third wager area to define a selected wager outcome. The player places the third wager on the player's prediction of the next rolled outcome. The payout is determined by comparing the rolled outcome to the selected wager outcome of the third wager. If the rolled outcome matches the selected wager outcome of the third wager, then a third payout equal to an amount as a function of a product of the wager amount of the third wager and the third payout multiplier 34. However, if the selected wager does not match the rolled outcome the house collects the wager amount.

Figure 3:
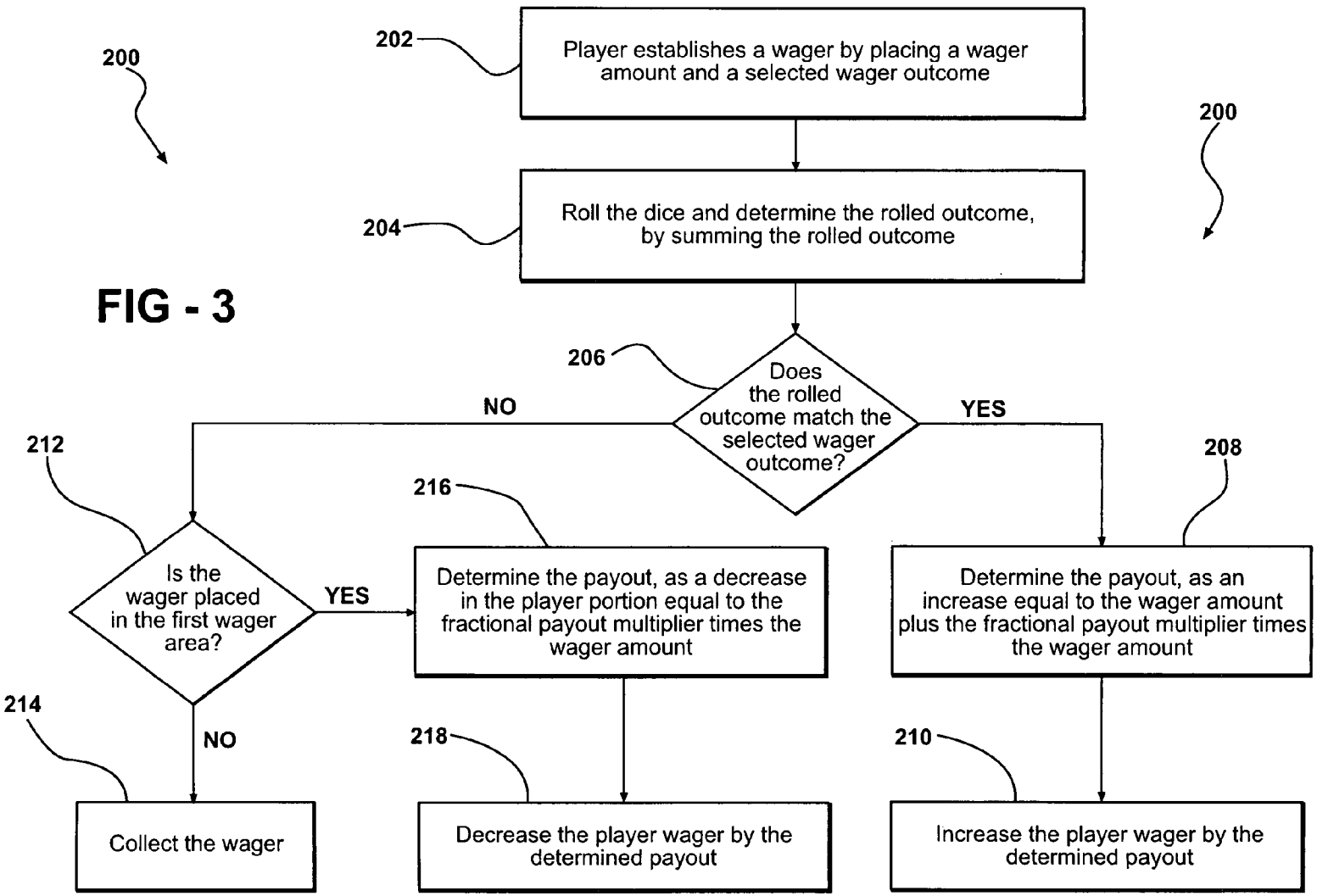
FIG. 3 is a block diagram illustrating a complete single game.

As illustrated in FIG. 3, a method 200 that includes a first step 202, to begin the game a player places a wager in one of the wager area, the first, second or third wager areas, 26, 28, 30 to indicate a selected wager outcome. Each wager consists of a wager amount and the selected wager outcome, corresponding to the player's prediction of a next rolled outcome of the dice 18. In a second step 204, the dice 18 are rolled to establish a rolled outcome of the dice 18 based on the sum of the values or indicators on the top faces 20 of the rolled dice 18. As known in the art, the dice 18 could be rolled by a player, a machine, randomly generated by a computer program, or a croupier. In a third step 206, the rolled outcome of the dice 18 is compared to the selected wager outcome. In a fourth step 208, a payout is calculated for a match between the selected wager outcome and the rolled outcome. The payout is a portion of the wager amount calculated as a function of the product of the wager amount where the payout multiplier is the fractional multiplier for wagers in the first area 26, the second multiplier for wagers in the second wager area 28, or the third multiplier for wagers in the third area 30. In a fifth step 210, the payout is paid increasing the wager amount. In a sixth step 212, if the rolled outcome does not match the selected wager outcome, it must be determined if the wager was placed in the first wager area. If the wager was not placed in the first wager area then the method includes a seventh step 214 of the house collecting the wager amount. If the wager was established in the first wager area 26 the method includes an eight step 216, where the payout is calculated by the function of the product of the wager amount and the fractional multiplier. Finally, in a ninth step 218 the wager amount is decreased by the payout.

One embodiment of the dice game includes the use of a pair of six sided die 18. The dice 18 each have six faces 20 and each face 20 presents one of the following fractional numbers ½, ¼, ⅛, −½, −¼ and −⅛. Therefore, the possible rolled outcomes are 1, ¾, ⅝, ½, ⅜, ¼, ⅛, −1, −¾, −⅝, −½, −⅜, −¼, −⅛, and a zero. The first wager area 26 presents the first wager indicator 36 to indicate the first group of numbers being the positive rolled outcomes, i.e., 1, ¾, ⅝, ½, ⅜, ¼, ⅛ and the second wager indicator 38 to indicate the second group of numbers being the negative rolled outcomes, i.e., −1, −¾, −⅝, −½, −⅜, −¼, −⅛. The second wager area 28 presents the third wager indicator 40 for the first group and the fourth wager indicator 42 for the second group of numbers. The third wager area 30 presents the wager indicators 44 for each of the possible rolled outcomes. A player establishes a player wager on one of the wager indicators 36, 38, 40, 42, 44 to define the selected wager outcome. The dice 18 are rolled and top faces 20 are algebraically summed to determine the rolled outcome. The rolled outcome is compared to the selected wager outcome to determine a winning match. A player having a winning match is paid the establish payout multiplier for the wager indicators 36, 38, 40, 42, 44 in each of the wager areas 26, 28, 30.

A winning match in the first wager area 26 to determine the payout results the fractional payout multiplier is determined for the rolled outcome, for this embodiment absolute value of the rolled outcome of dice 18. For example, a rolled outcome of ¾ or −¾ has a fractional payout multiplier of ¾ or 0.75. Therefore, each winning match in the first wager area 26 the payout is determined as a function of the product of the wager amount multiplied by fractional payout multiplier, i.e., the absolute value of the rolled outcome multiplied by the wager amount. A player wager in the first wager area 26 on a wager outcome other than the rolled outcome results in the payout as calculated being subtracted from the player wager amount. Also, if the rolled outcome is zero the wagers in the first wager area 26 are left as a push. This embodiment of the dice simplifies the determination of the fractional payout multiplier since it is equal to the absolute value of the rolled outcome. Additional versions of this simplification could include other fractional values or each face 20 could be an equivalent percentage rather than the fractional value, i.e., 12.5%, 25%, and 50% and the fractional payout multiplier could be determine from the sum of the rolled dice in that situation as a percentage increase for a winning match or a percentage decrease for other wagers in the first wager area. Also, as stated before the faces 20 of the dice and the rolled outcome could be any series of number or symbols each having a corresponding fractional payout multiplier.

Figure 5:
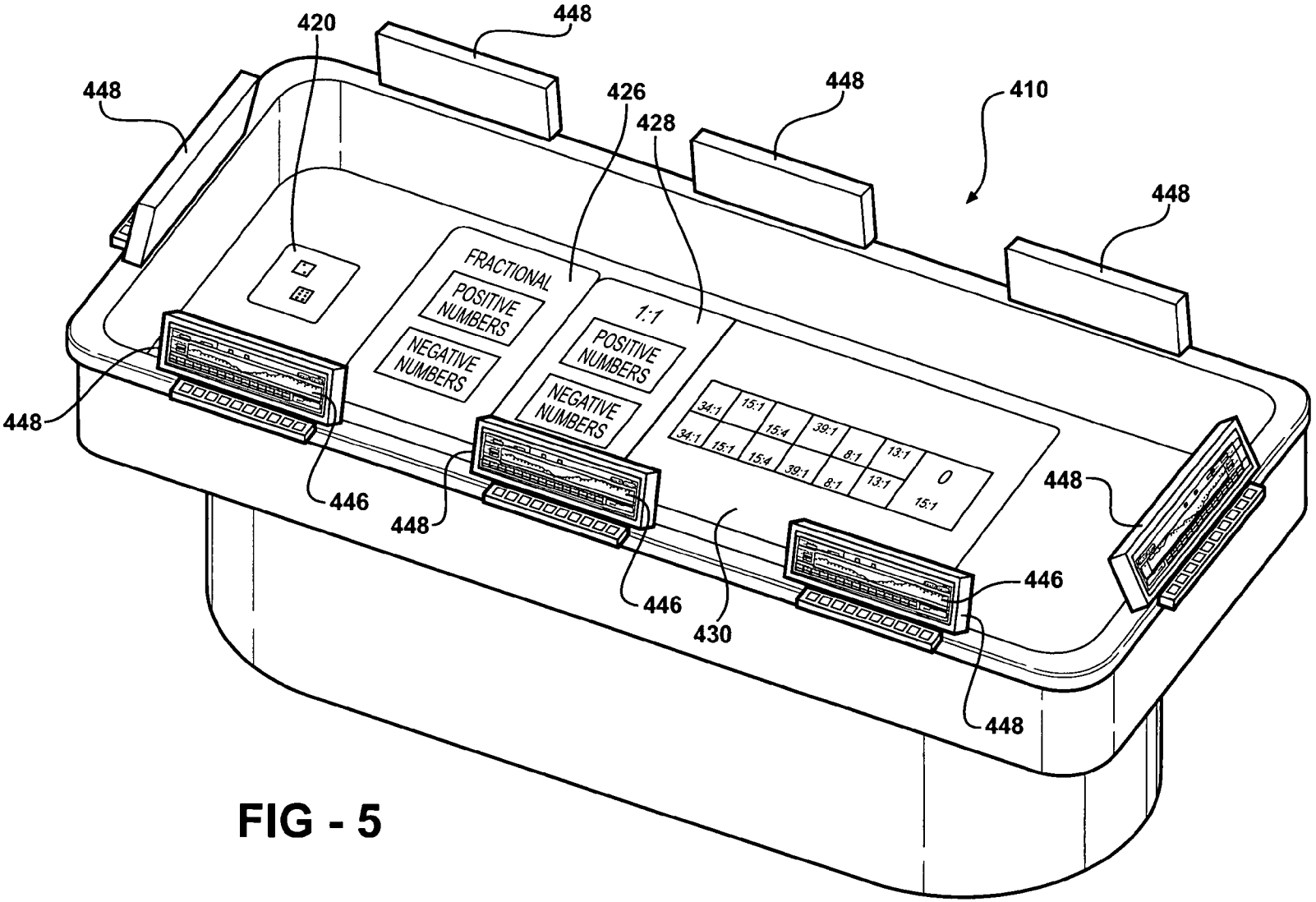
FIG. 5 is a perspective view of a table game for implementing a part or entire electronic version of the game.
Figure 6:
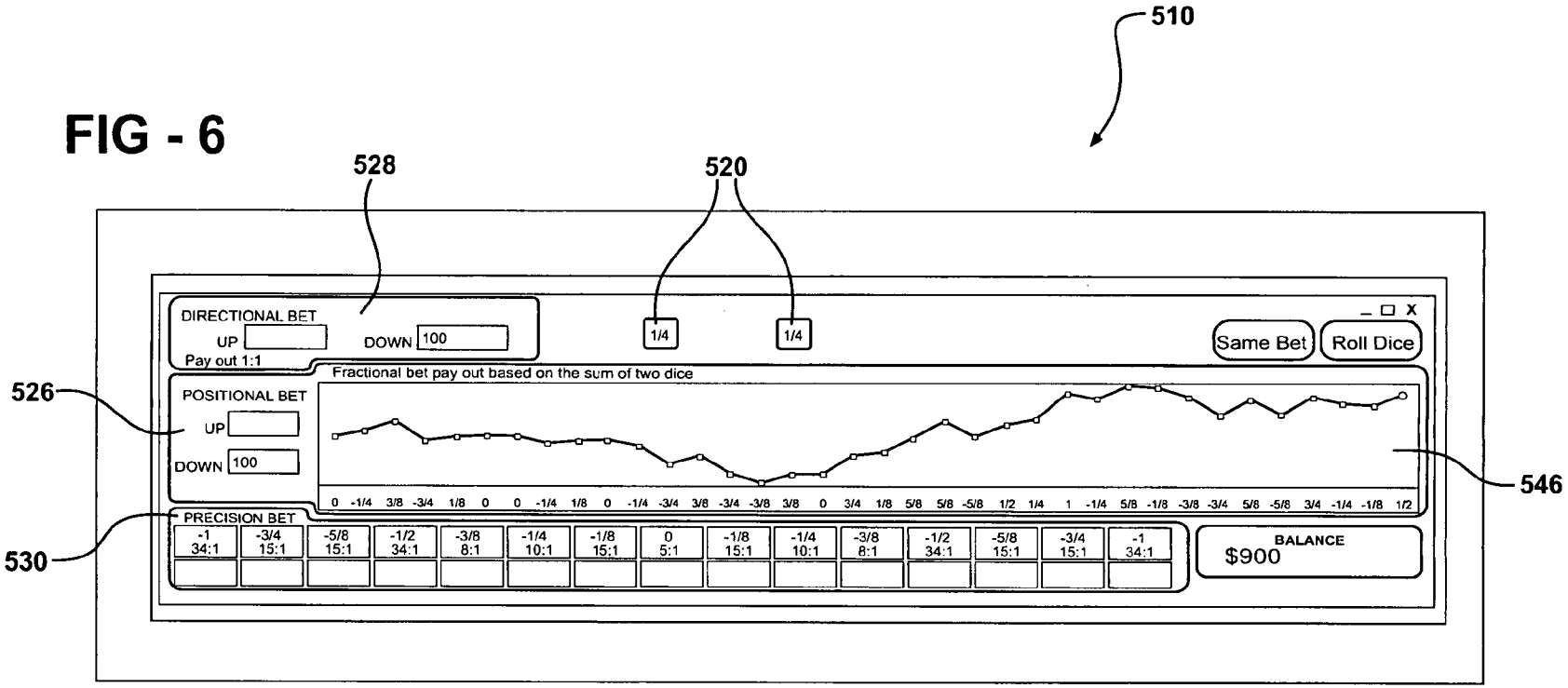
FIG. 6 is a screen display for a software version of the game.

In addition, as shown in FIG. 1, the table 10 can further incorporate a display 46. The display 46 adds visualization to the past rolled outcomes to create a trending or data line and may also display the past rolled outcome similar to roulette. The display 46 can add an additional excitement of a stock ticker type experience to the game. The display may provide additional excitement for player with wagers placed in the first wager area 26 since the player could watch the trend and a general increase or decrease to the wager amount over several rolled outcomes. As seen in FIGS. 5 and 6 the display can be incorporated as a graphic display 446, 546.

Figure 1A:
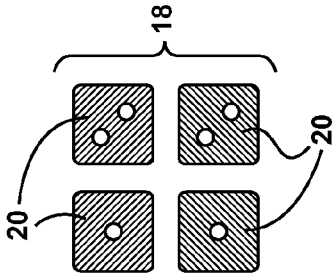
FIG. 1A is an illustration of two pairs of dice of different colors, represented by different shading.
Figure 4:
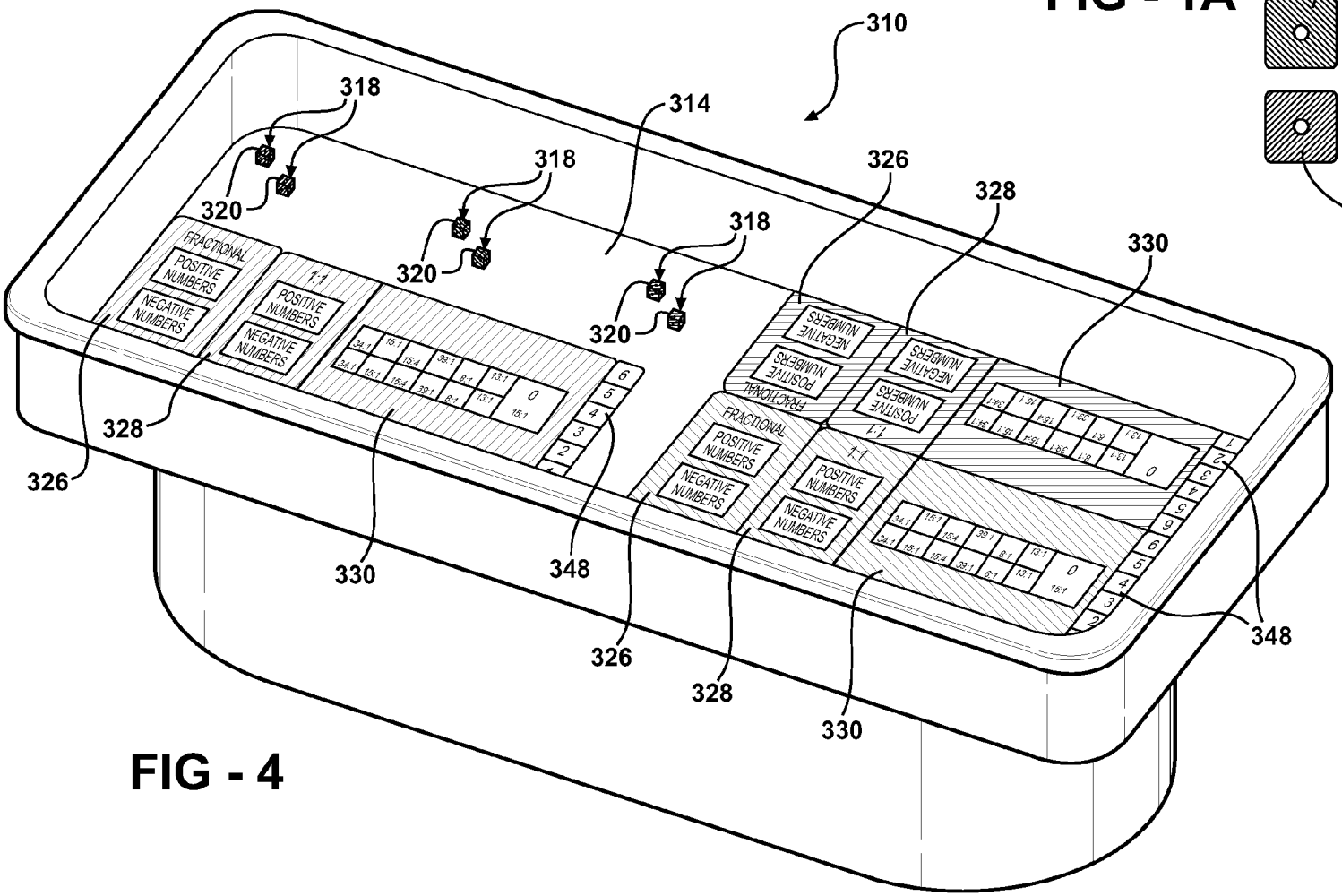
FIG. 4 is a perspective view of a table embodiment for playing multiple games on one playing surface.

An additional embodiment, as shown in FIG. 4, allows for a table 310 with multiple games played on a single playing surface 314. Each of the dice 318 is marked to identify the pair of die 318 corresponding to each game and each wagering area. The indicators could be additional markings on each face 320 of the dice 318 or simply having multiple pairs of die 318 of various colors or shading (see e.g., FIG. 1A, which shows two pair of dice, each pair having a different color represented by different shading). The playing surface 314 includes a first wager area 326, a second wager area 328 and a third wager area 330 for each of the games. The game further establishes a fourth wager area 348 presenting wager indicators to indicate a count number representing the amount of the dice 318 between the several games presenting one of the possible numbers of a face 320 of the dice 318. As shown in FIG. 4 the possible count numbers are 1, 2, 3, 4, 5 and 6, and three games are being played on the playing surface 314. A fourth payout multiplier is established for each count number. A player establishes a fourth wager by placing a fourth wager amount on the wager indicator to indicate a selected count number for the next rolled outcome of the several pairs of die 318. A payout is determined by comparing the rolled outcome of the several pairs of die 318 to the selected count number and paying if a selected count number matches the rolled outcome. A fourth payout is equal to an amount as a function of a product of the wager amount and the fourth payout multiplier. For example, a wager on the count number of 3, could have the fourth payout multiplier of 200, therefore, the payout would equal the fourth wager amount multiplied by the 200. This embodiment further can incorporate a large payout through the use of a progressive pot as a payout in the fourth wager area 348.

Additionally the game can be implemented on a variety of play surfaces 14. One embodiment, as shown in FIG. 1, is a standard table 10 game similar to a craps game, with a croupier to facilitate the play, collect losing wagers and pay off each of the player wagers. An electronic table version 410 of the game can further be incorporated on a table display as shown in FIG. 5. The electronic table 410 can simulate the feel of a traditional dice table while providing each player a wager area or electronic kiosk 448 to input the wagers on a first wager area 426, a second wager area 428 or a third wager area 430. The electronic table 410 can be implemented as a full computerized version or have a croupier to facilitate the play and payout of the game.

A software version 510, as shown in FIG. 6, can be incorporated into the electronic table or designed for play on a computer or a video gaming machine. The software version 510, establishes an input screen for the player to place wagers in the each of the wager area 526, 528 and 530. The computer generates the rolled outcome of the dice 520. The software calculates each of the payouts for the wager areas based on the rolled outcome. In addition, both the electronic table and software version could be implemented over a network or the internet.

Obviously, many modifications and variations of the present invention are possible in light of the above teachings. The invention may be practiced otherwise than as specifically described within the scope of the appended claims.

What is claimed is:

1. A method of playing a dice game having a pair of die, each die having an equal number of faces, each die having a plurality of an equal number of positive values and negative values, each face having an associated one of the positive and negative values, comprising the steps of:

establishing said plurality of positive values and negative values as being equal and opposite fractional values, the pair of dice having six faces presenting one of the following ½, ¼, ⅛, -½, -¼, and -⅛;

establishing a payout multiplier for each possible outcome of the dice the rolled outcome being equal to the sum of the associated values of a top face of each die;

establishing a wager by a player on one of the outcomes, the player wager having a wager amount and a selected wager outcome, the selected wager outcome being one of a positive dice outcome or a negative dice outcome;

rolling the two dice to establish a rolled outcome of the dice;

comparing the rolled outcome to the wager outcome;

paying to the player a payout as a function of a product of the wager amount and the payout multiplier, if the rolled outcome matches the wager outcome, the payout multiplier being equal to the absolute value of the rolled outcome of the dice.

2. A method as set forth in claim 1 wherein said dice game is implemented on a table having a playing surface for rolling the dice.

3. A method as set forth in claim 1 wherein said dice game is implemented as software for play on a computer.

4. A method as set forth in claim 3 wherein said dice game is implemented over a computer network.

5. A method of playing a dice game having a pair of dice each having six faces presenting the following numbers ½, ¼, ⅛, -½ -¼, and -⅛, a playing area for rolling the dice, said method comprising the steps of:

establishing a first wager area for each player presenting a first wager indicator to indicate a first group of numbers 1, ¾, ⅝, ½, ⅜, ¼, and ⅛, a second wager indicator to indicate a second group of numbers -1,-¾, -⅝, -½, -⅜, -¼ and -⅛;

establishing a second wager area for each player presenting a third wager indicator to indicate said first group of numbers and a fourth wager indicator to indicate said second group of numbers;

establishing a third wager area for each player presenting a first wager indicator to indicate each of first group of numbers, the second group of numbers and zero;

establishing player wagers on one of the wager indicators in at least one of said wager areas for each player to define a wager outcome for each player;

rolling the two dice to rolled faces presenting rolled numbers;

algebraically summing said rolled numbers to produce a rolled outcome;

comparing the rolled outcome to the wager outcome to identify winning matches of wager outcome to the rolled outcome;

paying each player having a winning match in the second wager area and the third wager area;

leaving as a push a player wager in the first wager area when the rolled outcome equals zero;

paying each player having a winning match in the first wager area a payout equal to the player wager plus the player wager multiplied by the rolled outcome to increase the player wager by the fractional value of the rolled sum regardless of the rolled outcome being positive or negative; and paying each player having a player wager in the third wager area on a wager outcome different than the rolled outcome an amount equal to the player wager minus the player wager multiplied by the rolled outcome to decrease the player wager by the fractional value of the rolled outcome regardless of the rolled sum being positive or negative.

6. A method, as set forth in claim 1, including the step of reducing the wager as a function of a product of the wager amount and the payout multiplier if the rolled outcome does not match the wager outcome.

* * * * *